United States Patent [19]

Hemel et al.

[11] Patent Number: 4,952,280

[45] Date of Patent: Aug. 28, 1990

[54] PROCESS FOR CONTROLLING THE ADDITION OF RETENTION AIDS IN PAPERMAKING

[75] Inventors: Ralf Hemel, Lampertheim; Jaroslav Melzer, Ludwigshafen, both of Fed. Rep. of Germany

[73] Assignee: BASF Aktiengesellschaft, Ludwigshafen, Fed. Rep. of Germany

[21] Appl. No.: 366,495

[22] Filed: Jun. 14, 1989

[30] Foreign Application Priority Data

Jul. 6, 1988 [DE] Fed. Rep. of Germany ..... 3822783

[51] Int. Cl.[5] ..... D21C 7/06

[52] U.S. Cl. ..... 162/198; 162/253; 162/DIG. 11

[58] Field of Search ..... 162/198, 252, 253, 263, 162/DIG. 10, DIG. 11, 262

[56] References Cited

U.S. PATENT DOCUMENTS 4,752,356 6/1988 Taggert et al. ..... 162/198

OTHER PUBLICATIONS

Masse et al.; "Most Modern Stock Preparation Features Complex Blending System"; Paper Trade Journal, Aug. 13, 1962, pp. 32–39.

Paper Technology; "Measures Fibre Charge On-Line", PT Dec./Jan. 1989.

Paper Trade Journal, "Optical Device Installed at Wet End Monitors Single-Pass Filler Retention", Mar. 1, 1977, pp. 32–34.

Perry et al., "Perry's Chemical Engineering Handbook, Fourth Ed.", McGraw Hill, N.Y., 1963, pp. 2-75–2-77.

*Primary Examiner*—Steve Alvo

*Attorney, Agent, or Firm*—Keil & Weinkauf

[57] ABSTRACT

The maximum amounts of the retention-influencing variable stock components which can be added are determined as a function of a predetermined degree of flocculation and typical values of the stock suspension with the aid of a mathematical relationship, and control signals for metering retention aids are derived from the amounts so that the greatest possible retention can be achieved without exceeding a set-point for the degree of flocculation.

1 Claim, No Drawings

PROCESS FOR CONTROLLING THE ADDITION OF RETENTION AIDS IN PAPERMAKING

The present invention relates to a process for controlling the addition of retention aids in papermaking.

For automatic control of the addition of variable stock components which influence retention and flocculation, systems which measure the total stock concentration and filler concentration in the headbox suspension and in the white water with the aid of appropriate sensors have been used to date. From these measured data, the one-pass retention of the total stock and of the fibers and fillers were calculated using known formulae. By controlling the addition of one or more retention aids and flocculants, an attempt was then made to obtain very high retention values. The degree of flocculation was not measured or taken into account.

However, apart from high retention, it is just as important that the paper made has a very uniform look-through, ie. good formation. However, this is impaired to a greater or lesser extent with increasing degree of flocculation as a result of the addition of increasing amounts of retention aids and flocculants. This means that, in the case of the abovementioned control, the retention values at which the formation is still acceptable must first be found by preliminary experiments. These values are then used as set-point values for the control. The formation is also dependent on the particular stock composition, so that this adjustment must be made for each type of paper running on the paper machine. Even then, however, it is not certain whether good formation will be achieved, since variations in the quality of the raw materials used cannot be taken into account.

It is an object of the present invention to provide a process for controlling the addition of retention aids, by means of which the metering of one or more retention aids can be adjusted as a function of a predetermined, maximum permissible degree of flocculation and of the stock composition.

We have found that this object is achieved, according to the invention, if the maximum amounts of the retention-influencing variable stock components ($X_i, \ldots X_n$) which can be added are determined from a predetermined, maximum permissible degree of flocculation ($Y_2$) and typical values of the stock suspension ($X_1, \ldots X_n$) with the aid of the mathematical relationship $$Y_2 = f_2(X_1, \ldots X_i, \ldots X_n),$$

the actual values of the degree of flocculation and of the retention being monitored continuously by measuring the suspension, and control signals for metering apparatuses for these components are derived from the amounts ($X_i, \ldots X_n$).

The Example which follows illustrates the process according to the invention.

First, apart from the retention, the degree of flocculation of the stock suspension in the paper machine is also measured. The retention is measured using the known systems described above and the degree of flocculation is also measured by means of known systems, for example with a flocculation sensor according to EP-A-01 57 310.

With the aid of statistical methods, the effect of the variable stock values ($X_1, \ldots X_n$), such as the composition of the fiber content of the stock and its freeness, the pH of the suspension, the amount of alum, the amount of retention aid and the amount of filler, on the retention and on the degree of flocculation is determined and is used to set up empirical equations $$Y_1 = f_1(X_1, \ldots X_i, \ldots X_n) \quad \text{(I)}$$

$$Y_2 = f_2(X_1, \ldots X_i, \ldots X_n) \quad \text{(II)}$$

which are stored as a control algorithm in an electronic computer. The computer also continuously receives measured data for the variable stock values or amounts, so that, for a set-point value to be input for the degree of flocculation, ie. the maximum permissible degree of flocculation ($Y_2$), the maximum amounts of the retention-influencing variable stock components ($X_i, \ldots X_n$) which may be added can be determined. Control signals for metering apparatuses, for example metering pumps, for these components are then derived from the amounts.

As stated above, the retention ($Y_1$) also depends on the variable stock values ($X_1, \ldots X_n$), so that the result is an optimum combination of the added amounts of the retention-influencing, variable stock components, for which combination maximum retention is obtained for a set-point value of the degree of flocculation. For this purpose, the amounts of these variable components ($X_i, \ldots X_n$) for the instantaneous setting of the stock values ($X_1, \ldots X_{i-1}$) are varied in the computer so as to find a combination of values for which both the equation (II) of the set-point value of the degree of flocculation ($Y_2$) is satisfied and a maximum retention ($Y_1$) of the stock according to equation (I) is achieved. The control signals for the corresponding metering apparatuses for the variable stock components are in turn derived from the amounts obtained in this manner.

EXAMPLE

In a test series on a paper machine, the freeness of the stock ($X_1$), the pH ($X_2$), the amount of alum ($X_3$), the amount of retention aid ($X_4$) and the amount of filler ($X_5$) were varied and the following equations for the total stock retention ($Y_1$) and the degree of flocculation ($Y_2$) were obtained from the measured data by means of mathematical statistical methods:

$$Y_1 = 92.33 + 0.18 \cdot X_3 - 19.79 \cdot X_4 - 0.49 \cdot X_5 - 0.26 \cdot X_3^2 + 0.16 \cdot X_1 \cdot X_4 + 1.02 \cdot X_2 \cdot X_4 + 0.04 \cdot X_2 \cdot X_5 + 0.22 \cdot X_4 \cdot X_5$$

$$Y_2 = 2.76 - 0.09 \cdot X_5 - 0.0004 \cdot X_1^2 - 1.11 \cdot X_4^2 + 0.001 \cdot X_1 \cdot X_5 + 0.58 \cdot X_2 \cdot X_4 - 0.13 \cdot X_3 \cdot X_4$$

With the aid of these two equations, it was then possible to select the amount of retention aid and the amount of alum for each value and each combination of the abovementioned variables in such a way that a degree of flocculation of, for example, 1.5 was not exceeded and in each case maximum retention was achieved.

We claim:

1. A process for controlling the addition of retention aids in papermaking, which comprises:

(a) determining a set-point degree of flocculation of a stock suspension;

(b) measuring the retention and degree of flocculation of a stock suspension;

(c) determining the effect of variable stock values ($X_1, \ldots X_n$), on the retention and the degree of flocculation with the aid of statistical methods;

(d) using the determined effect of stock values to set up empirical equations:

$$Y_1 = f_1 (X_1, \ldots X_i \ldots X_n); \quad \text{(I)}$$

and $$Y_2 = f_2 (X_1, \ldots X_i \ldots X_n); \quad \text{(II)}$$

where $Y_1$ represents the total retention and $Y_2$ represents the set-point degree of flocculation;

(e) storing the empirical equations as a control algorithm in a computer;

(f) continuously inputting measured data of the stock values to the computer so that a maximum amount of retention-influencing stock components can be determined; and (g) sending control signals from the computer to a metering apparatus to control the input of retention aids so that the greatest possible retention can be achieved without exceeding the set-point degree of flocculation.

* * * * *